US010822789B1

(12) United States Patent
Mou et al.

(10) Patent No.: US 10,822,789 B1
(45) Date of Patent: Nov. 3, 2020

(54) FOLDING SLAB AND CENTRAL COLUMN COMPOSITE JOINT AND ASSEMBLY METHOD THEREOF

(71) Applicant: QINGDAO UNIVERSITY OF TECHNOLOGY, Qingdao (CN)

(72) Inventors: Ben Mou, Qingdao (CN); Dongshuai Hou, Qingdao (CN); Yi Liu, Qingdao (CN); Zunqiang Li, Qingdao (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 0 days.

(21) Appl. No.: 16/939,092

(22) Filed: Jul. 27, 2020

(30) Foreign Application Priority Data

Sep. 4, 2019 (CN) ..... 2019 1 0832774

(51) Int. Cl.

| | |
|---|---|
| ***E04B 1/26*** | (2006.01) |
| ***E04B 1/30*** | (2006.01) |
| ***E04B 5/12*** | (2006.01) |
| ***E04C 3/36*** | (2006.01) |
| ***E04B 5/02*** | (2006.01) |

(52) U.S. Cl.
CPC ..... *E04B 1/2608* (2013.01); *E04B 1/30* (2013.01); *E04B 5/023* (2013.01); *E04B 5/12* (2013.01); *E04C 3/36* (2013.01); *E04B 2001/2644* (2013.01); *E04B 2001/2652* (2013.01); *E04B 2103/04* (2013.01)

(58) Field of Classification Search
None
See application file for complete search history.

(56) References Cited

U.S. PATENT DOCUMENTS

| | | | | |
|---|---|---|---|---|
| 3,828,512 | A * | 8/1974 | Johnson | E04B 1/3538 52/745.11 |
| 2005/0016111 | A1* | 1/2005 | Knepp | E02D 29/0275 52/633 |
| 2007/0062147 | A1* | 3/2007 | Wright | E04B 5/12 52/582.1 |
| 2010/0071315 | A1* | 3/2010 | Hong | E04C 3/293 52/848 |
| 2015/0068138 | A1* | 3/2015 | Rubel | E04B 5/023 52/98 |
| 2016/0032580 | A1* | 2/2016 | Rahimzadeh | E04B 5/19 52/236.9 |
| 2018/0135295 | A1* | 5/2018 | Bowron | E04B 1/2604 |
| 2020/0270865 | A1* | 8/2020 | Louw | E04B 1/165 |

FOREIGN PATENT DOCUMENTS

CN 104727439 A 6/2015

* cited by examiner

*Primary Examiner* — Joshua K Ihezie
(74) *Attorney, Agent, or Firm* — Bayramoglu Law Offices LLC

(57) ABSTRACT

A folding slab and a central column composite joint and an assembly method thereof, wherein the folding slab and a prefabricated column-beam composite joint adopting a steel-wood composite structure guarantees a construction quality, improves a construction efficiency, and optimizes a seismic performance of a structure. The folding slab and the central column composite joint including a steel-wood composite column, square wood columns, connecting assemblies for connecting the steel-wood composite column and the square wood beams, and folding wood slabs connected with and supported by the steel-wood composite column, the square wood columns and the connecting assemblies.

8 Claims, 7 Drawing Sheets

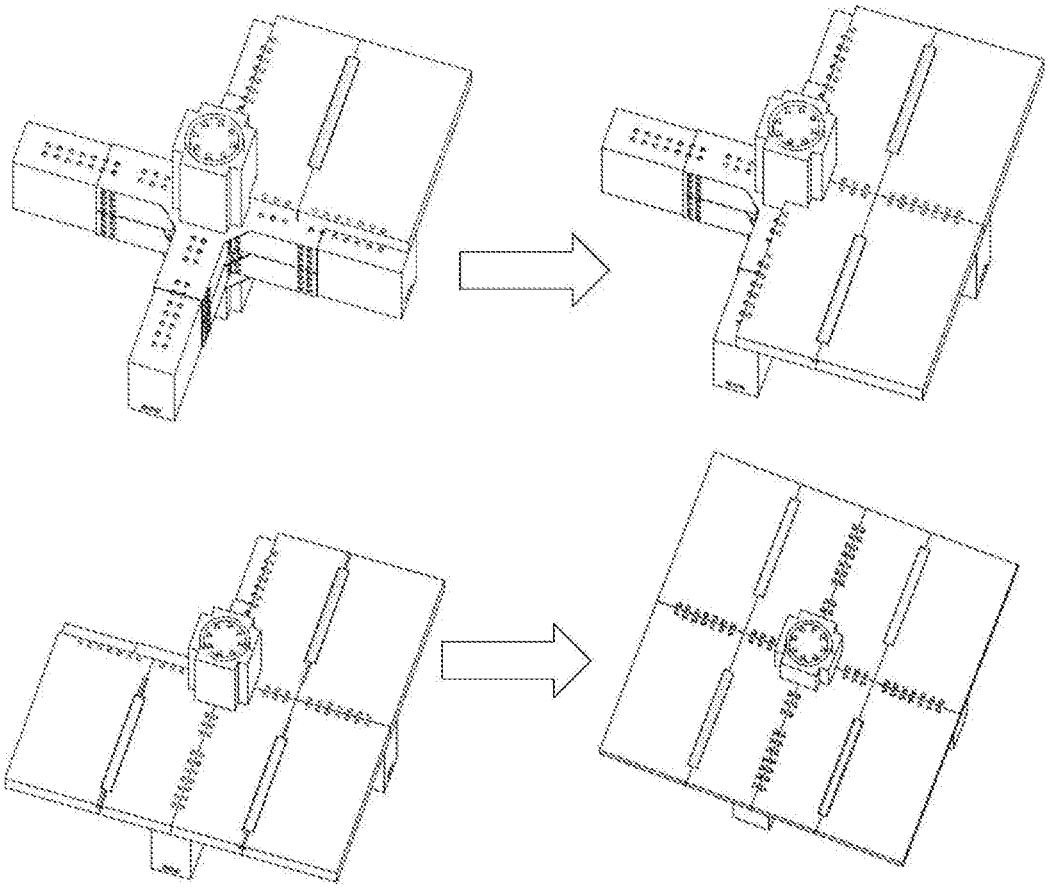
FIG. 13
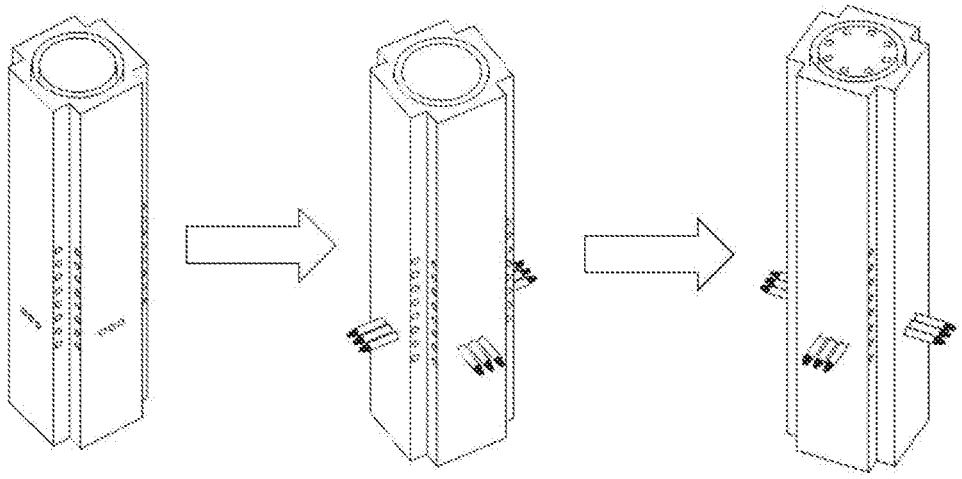

FOLDING SLAB AND CENTRAL COLUMN COMPOSITE JOINT AND ASSEMBLY METHOD THEREOF

CROSS REFERENCES TO THE RELATED APPLICATIONS

This application is based upon and claims priority to Chinese Patent Application No. 201910832774.3, filed on Sep. 4, 2019, the entire contents of which are incorporated herein by reference.

TECHNICAL FIELD

The present invention relates to a folding slab and central column steel-wood composite joint, and belongs to the field of building construction.

BACKGROUND

With the gradual popularization of the green ecological concept, quality and efficiency improvement, energy conservation and emission reduction have become inevitable requirements of construction and production in the construction industry and give rise to steel-wood composite structures.

Traditional wood-structured buildings have high durability and good seismic performance and are featured by easily available materials and high construction speed. However, the wood-structured buildings are inferior in the aspects of fire protection and moisture protection.

For example, previous Chinese Patent Application No, CN201510106368.0 discloses a novel prefabricated concrete column-beam structure and an assembly and connection method thereof. The novel prefabricated concrete column-beam structure comprises prefabricated concrete edge columns abbreviated as prefabricated edge columns hereinafter, prefabricated concrete central columns abbreviated as prefabricated central columns hereinafter, and prefabricated concrete beam structures abbreviated as prefabricated beams hereinafter, wherein, column top grouting grooves are formed in the tops of the prefabricated edge columns and have column vertical steel bars assembled therein, and the lower ends of the column vertical steel bars stretch into column sleeves; column bottom grouting grooves are formed in the bottoms of the prefabricated edge columns, edge column bar slots are formed in the outer sides of the bottoms of the prefabricated edge columns, across-beam steel bar holes penetrating through the edge columns are formed in the tops of edge column bar slots, and edge column reserved steel bars and steel bars connected to beam bottom steel bars are arranged at the tops of the prefabricated edge columns; column top grouting grooves are formed in the tops of the prefabricated middle columns, column bottom grouting grooves and across-beam steel bar holes are formed in the bottoms of the prefabricated middle columns, and middle column reserved steel bars and steel bars connected to the beam bottom steel bars are arranged at the tops of the prefabricated middle columns; outer column stirrups and inner column stirrups are arranged in the prefabricated edge columns and the prefabricated middle columns in the height direction of the edge columns; and steel poles having embedded ends tapped with threads and beam stirrups are regularly arranged in the length direction of the prefabricated beams, and the beam bottom steel bars are arranged at the bottoms of the prefabricated beams.

Compared with existing common assembled slab design techniques, the above solution mainly adopts the prefabricated concrete structure and steel bar connecting structure and has the disadvantages that materials are difficult to obtain, modular connection and construction cannot be realized, and the construction speed is low; and more importantly, welding has to be conducted to improve the strength of steel connection joints, and the construction quality cannot be guaranteed. Moreover, the weight of the whole joints is large, and the bearing capacity of the joints is relatively low.

To sum up, the building joint techniques in the prior art cannot be widely popularized in the industry and are low in degree of standardization. In view of this, this patent application is put forward.

SUMMARY

The present invention provides a folding slab and central column composite joint and an assembly method thereof. To solve the problems of the prior art, a folding slab and prefabricated column-beam composite joint of a steel-wood composite structure is adopted to fulfill the design purposes of improving joint strength, reducing quality problems caused by welding, improving the overall bearing capacity and lowering the probability of joint destruction by means of steel-based mechanical connection.

To fulfill the aforesaid design purposes, the folding slab and central column composite joint mainly comprises a steel-wood composite column, square wood beams, connecting assemblies for connecting the steel-wood composite column and the square wood beams, and folding wood slabs connected with and supported by the steel-wood composite column, the square wood beams and the connecting assemblies;

The steel-wood composite column comprises a hollow cross-shaped outer wood column, wherein a steel sleeve is inlaid in the cross-shaped outer wood column, an inner wood column is inlaid in the steel sleeve, column vertical steel bars penetrate through the inner wood column, inner ends of horizontal steel bars penetrate through the cross-shaped outer wood column to be fixedly connected to the steel sleeve, tapered threads are arranged at outer ends of the horizontal steel bars, and first bolt holes to be connected to the connecting assemblies are formed in two sides of a cross-shaped surface of the cross-shaped outer wood column;

A spindle is connected between every two adjacent folding wood slabs, and third bolt holes to be connected to the square wood beams and the connecting assemblies are formed in edge joints of the folding wood slabs;

The square wood beams have vertical protruding steel bars stretching therein, and threads are arranged at outer ends of the vertical protruding steel bars;

Each connecting assembly comprises a threaded sleeve having two ends respectively connected to the horizontal steel bars and vertical protruding steel bars, and a double ring plate;

Second bolt holes to be connected to the double ring plates are formed in two sides of the ends of the square wood beams, and third bolt holes to be fixedly connected to the folding wood slabs are formed in the tops of the square wood beams; and The double ring plate comprises a cross-shaped upper ring plate and a cross-shaped lower ring plate, wherein corner plates are arranged on connected cross-shaped roots of the upper ring plate and the lower ring plate, and fourth bolt holes used for fixed connection after the upper ring plate and the lower ring plate are overlapped are formed in the corner plates; first bolt holes to be connected to the cross-shaped outer wood column are formed in inner ends, close to the cross-shaped roots, of the upper ring plate and the lower ring plate; second bolt holes to be connected to the square wood beams are formed in outer sides of the ends of the upper ring plate and the lower ring plate; and third bolt holes to be connected to the square wood beams and the folding wood slabs are formed in the top ends of the upper ring plate and the lower ring plate.

On the basis of the above basic design concept, compared with traditional reinforced concrete structures, the folding slab and prefabricated column-beam composite joint of the present application adopts a steel-wood composite structure, formed by combining a steel structure and a wood structure, to give full play to the excellent properties of different materials and is of important significance for guaranteeing the overall seismic performance and disaster-prevention performance of buildings.

According to the folding slab and central column composite joint of the steel-wood composite structure, complementation of materials is realized by combining two materials, so that the strength of the wood structure is obviously improved; by adding the wood structure in the steel structure, the structural weight can be reduced, the structural strength per unit mass is improved, and the durability is extremely high. The modular structure allows materials to be obtained easily, and the construction speed is high. The beams and the column are mechanically connected by means of steel, so that the strength of the joint is improved, and quality problems caused by welding are reduced; by adding the steel structure in the wood column structure, the overall bearing capacity of the wood structure is remarkably improved; and the entire composite joint has high strength, the probability of joint destruction can be lowered to a certain extent, and the joint is restorable.

Compared with solid wood columns, the strength of the steel sleeve of the steel-wood composite column is greatly improved, the horizontal steel bars arranged in the cross-shaped outer wood column can greatly improve the stress performance and seismic performance, and the bearing capacity per unit mass of the steel-wood composite column is higher than that of pure wood structures. The column vertical steel bars are arranged in the inner wood column of the steel-wood composite column, so that the pressure-bearing performance and tensile strength of the wood column is improved, and the seismic performance per unit mass is superior.

The vertical steel bars in the square wood beams can remarkably enhance the tensile strength of the beams to ensure that the square wood beams have good seismic performance per unit mass.

The spindles are arranged in the folding slabs, so that splicing between every two adjacent slabs is reduced, good assembly performance is realized, the construction efficiency is improved accordingly, the construction cost is reduced, and the level of standardization and productization of building construction is high.

The cross-shaped outer wood column and the square wood beams are mechanically connected by the connecting assemblies adopting the threaded steel bar sleeves, connection is easy and convenient, and welding is not needed, so that the construction quality and efficiency are greatly improved; and the double ring plates are formed by overlapped connection of the upper and lower ring plates of the same structure, can further enhance the connection on the basis of the threaded sleeves, and can remarkably improve the strength of beam-column joints, so that shear failures of welded parts of the beam-column joint in an earthquake are effectively reduced, and good semiotic performance is realized.

To further improve the connection stability and the bearing capacity, in a preferred solution, the upper ring plate and lower ring plate of the double ring plate have cross-shaped slots identical in shape with the cross-shaped outer wood column. After the entire composite joint is assembled, the steel-wood composite column can penetrate through the connecting assemblies via the cross-shaped slots, and finally, basic connection of the central column composite joint is completed.

Through secondary beam-column connection by the double ring plates, transitional, reinforced and fastened connection of the slabs with the beams and the column is realized, that is, an existing steel bar welding process can be replaced on the basis of mechanical connection of the threaded sleeves, the steel bars in the beams and the steel bars in the column, so that quality problems caused by welding can be avoided.

To improve the connection stability of the upper ring plates and the lower ring plates, dovetail concave grooves and dovetail convex grooves used for insertion are symmetrically formed in connected edges of the upper ring plates and the lower ring plates, that is, the upper ring plates and the lower ring plates can be stably connected in an inserted manner by means of the dovetail groove structures.

To assist in the improvement of the connecting assemblies and improve the bearing capacity of the slab composite structure and the utilization rate of wood, the following preferred and improved solution may be adopted:

Near-column slabs and square slabs of the folding wood slabs are connected through the spindles, W-shaped slots matched with the cross-shaped outer wood column are formed in near-column ends of the near-column slabs, and a cross-shaped slot is formed by the W-shaped slots of the four adjacent near-column slabs.

The four adjacent near-column slabs of the folding wood slabs are disposed around the steel-wood composite column, and the square slabs encircle the near-column slabs. The fixation manner of the assembled slabs can effectively improve the construction efficiency of the slabs, further improve the fixed connection of the slabs, the beams and the column, and realize cyclically developing buildings.

On the basis of the structural design of the folding slab and central column composite joint, the present application further provides a corresponding assembly method, which comprises:

Step 1): disposing the steel sleeve in the cross-shaped outer wood column, welding and fixing the horizontal steel bars, filling the inner wood column in the cross-shaped outer wood column, and inserting the column vertical steel bars in the inner wood column;

Step 2): inserting the vertical protruding steel bars in the square wood beams, and enabling the steel bars to protrude out of the square wood beams;

Step 3): after the steel-wood composite column and the square wood beams are assembled, connecting protruding parts of the steel bars through the threaded sleeves (9);

Step 4): inserting the upper ring plates and the lower ring plates into each other by means of the dovetail groove structures, and assembling and fixing the corner plates of the upper ring plates and the lower ring plates to form the double ring plates;

Step 5): inserting the cross-shaped outer wood column into the double ring plates via the cross-shaped slots, and fastening and connecting the double ring plates with the cross-shaped outer wood column and the square wood beams through bolts; and Step 6): disposing the four adjacent folding wood slabs around the cross-shaped outer wood column, and overlapping, fastening and connecting the near-column slabs and the square slabs with the double ring plates and the square wood beams through bolts.

As described above, the folding slab and central column composite joint and the assembly method thereof provided by the present application have the following advantages:

1. The novel prefabricated steel-wood composite joint structure provided by the present application increases the utilization rate of different building materials, realizes advantage complementation of different materials, and enriches modern building systems.

2. The design of the assembled joint realizes construction productization, shortens the construction period and reduces the construction cost.

3. The components can be prefabricated in advance, so that the construction process is simplified, and the construction efficiency is improved.

4. The beam and the columns are connected by the mechanical connecting assemblies of a steel structure, so that quality problems caused by welding of steel structures are effectively avoided; and the connecting assemblies of the steel structure are high in strength, thus improving the stress performance of the joint.

5. By adoption of the folding slabs, rapid prefabricated construction of the slabs is realized, the construction process is simplified, the construction period is shortened, the construction cost is reduced, and good economic performance is realized.

6. The design of the steel-wood composite structure improves the overall bearing capacity of the structure, enhances the semiotic performance of components, realizes the restorability after destruction, and satisfies the recycling requirements of building development.

BRIEF DESCRIPTION OF THE DRAWINGS

FIG. 13 is an assembly diagram of a folding wood slab composite joint; and

In the figures: 1, steel-wood composite column; 2, square wood beam; 3, folding wood slab; 4, connecting assembly; 5, cross-shaped outer wood column; 6, column vertical steel bar; 7, horizontal steel bar; 8; steel sleeve; 9, threaded sleeve; 10; vertical protruding steel bar; 11, double ring plate; 12, first bolt hole; 13, second bolt hole; 14, third bolt hole; 15, corner plate; 16, spindle; 17, near-column slab; 18, square slab; 19, inner wood column; 20, fourth bolt hole; 21, cross-shaped slot; 22, cross-shaped slot; 23, dovetail concave groove; 24, dovetail convex groove; 123, upper ring plate; 456, lower ring plate.

DETAILED DESCRIPTION OF THE EMBODIMENTS

Embodiment 1: A detailed description of the embodiments of the present application is given below in conjunction with the accompanying drawings.

Figure 1:
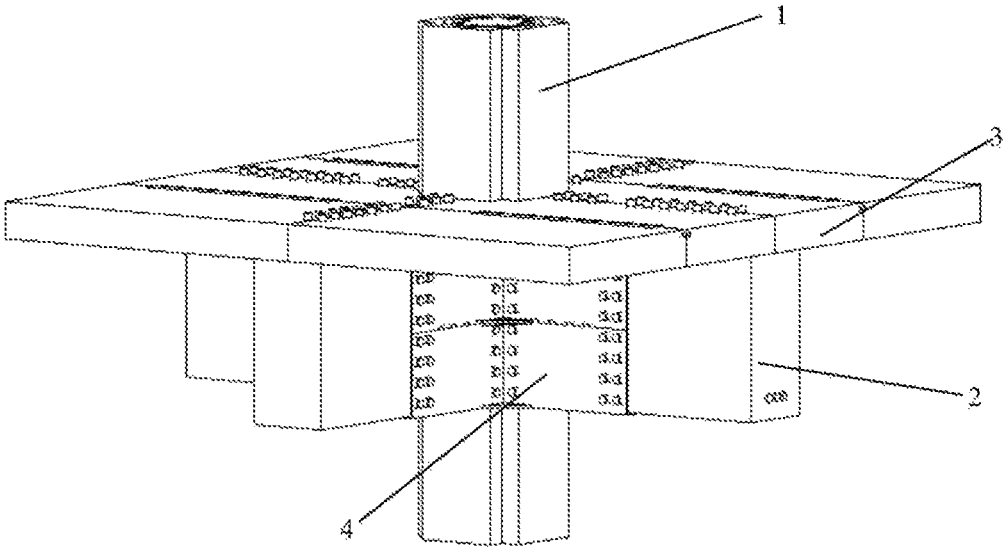
FIG. 1 is a structural diagram of an assembled beam-type steel-wood composite joint of the present application.
Figure 2:
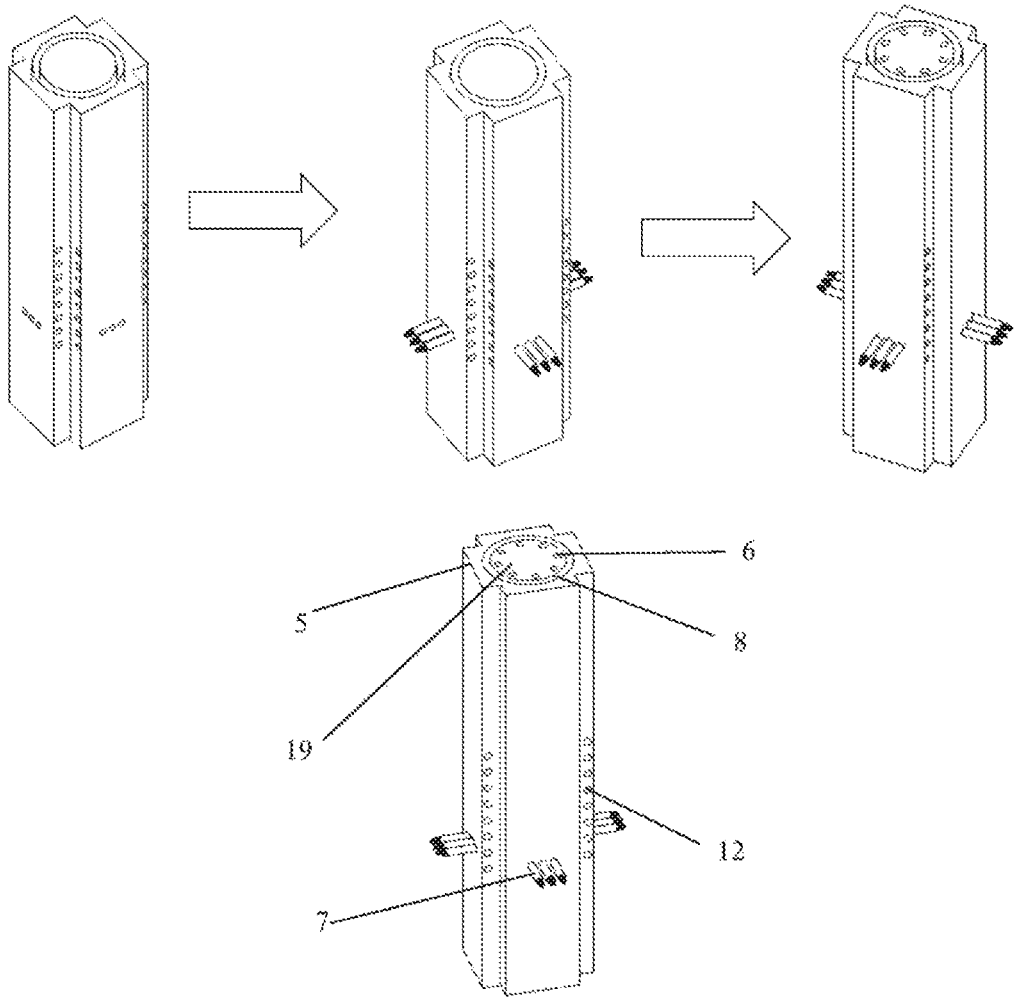
FIG. 2 is a schematic diagram of the structure and assembly process of a steel-wood composite column.
Figure 3:
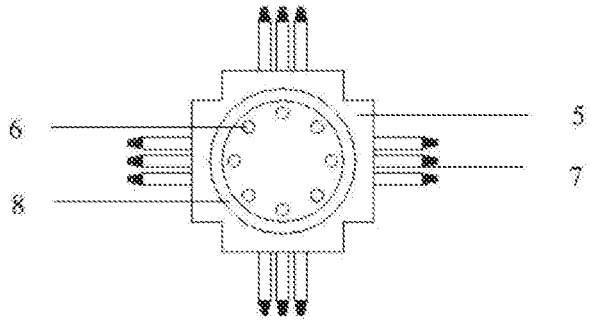
FIG. 3 is a sectional view of the steel-wood composite column.
Figure 4:
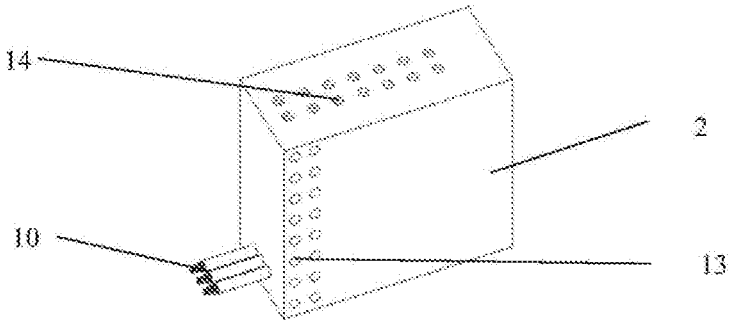
FIG. 4 is a structural diagram of a square wood beam.
Figure 5:
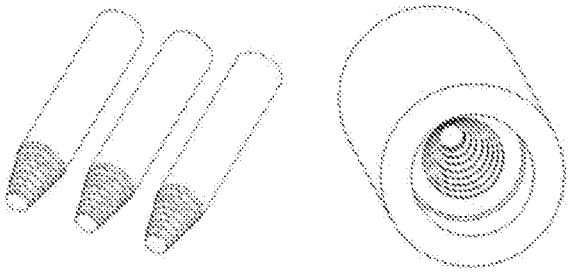
FIG. 5 is a structural diagram of a threaded sleeve.
Figure 6:
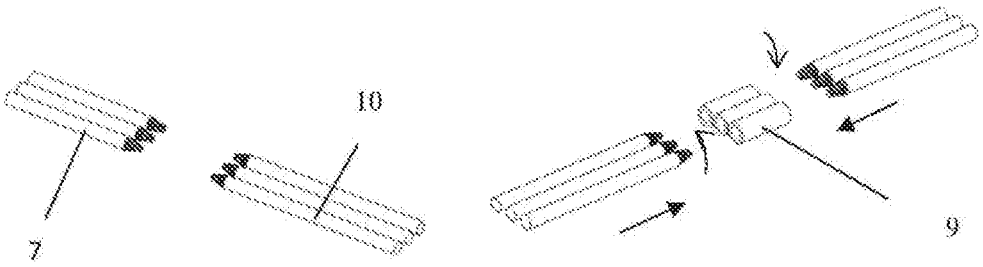
FIG. 6 is a schematic diagram of the connection process of threaded sleeves and steel bars.
Figure 7:
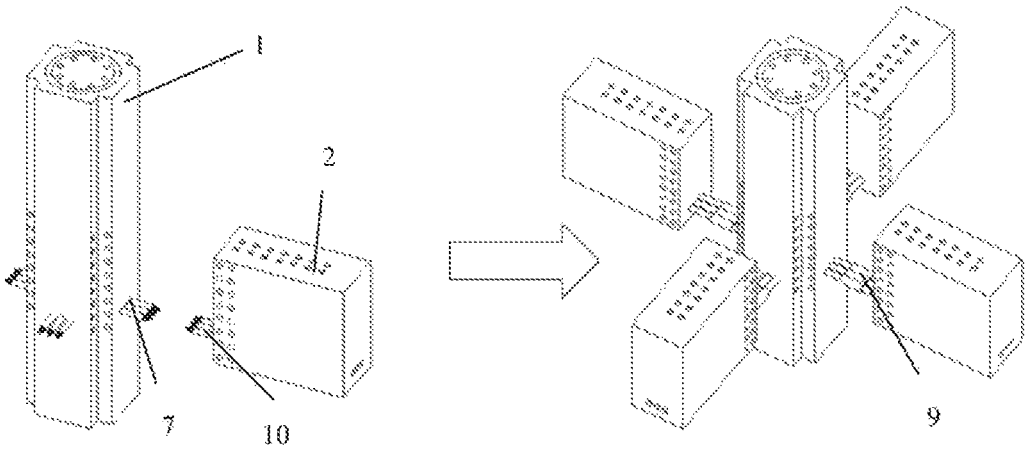
FIG. 7 is an overall schematic diagram of column-beam connection by means of the threaded sleeves.
Figure 8:
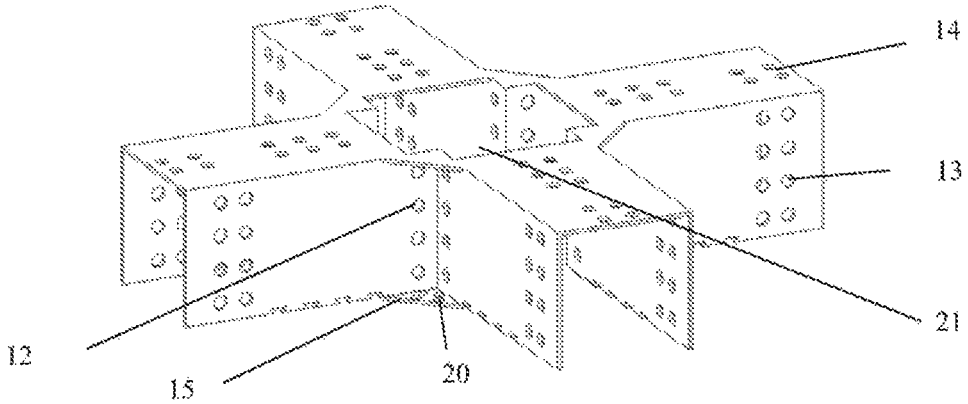
FIG. 8 is a structural diagram of an upper ring plate.
Figure 9:
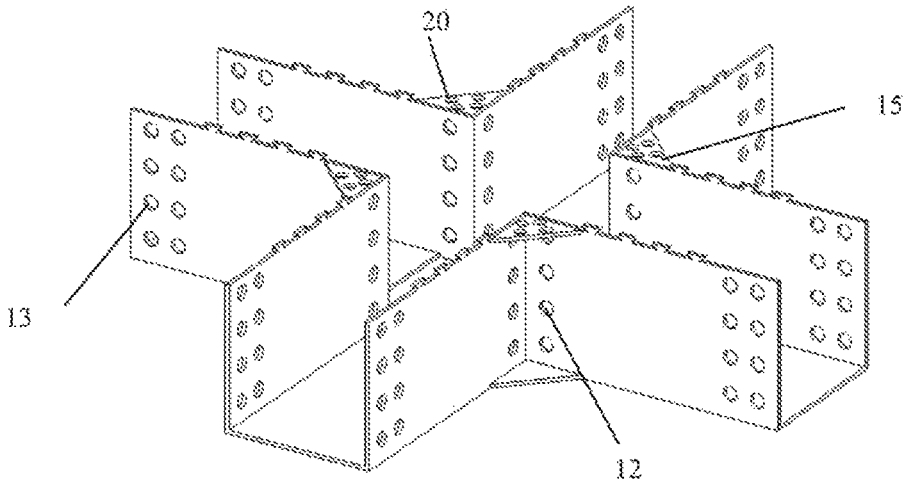
FIG. 9 is a connection diagram of two ring plates.
Figure 10:
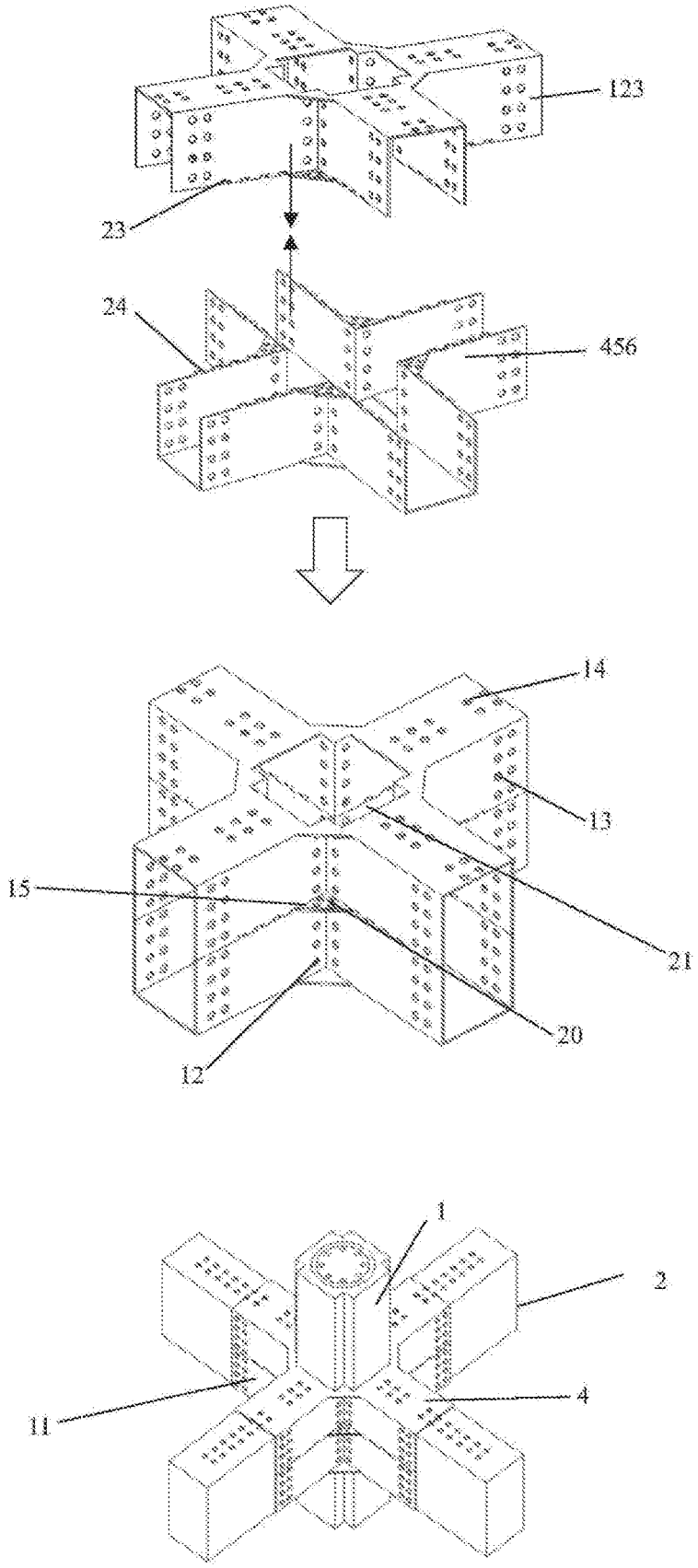
FIG. 10 is a structural diagram of the two ring plates after connection.
Figure 11:
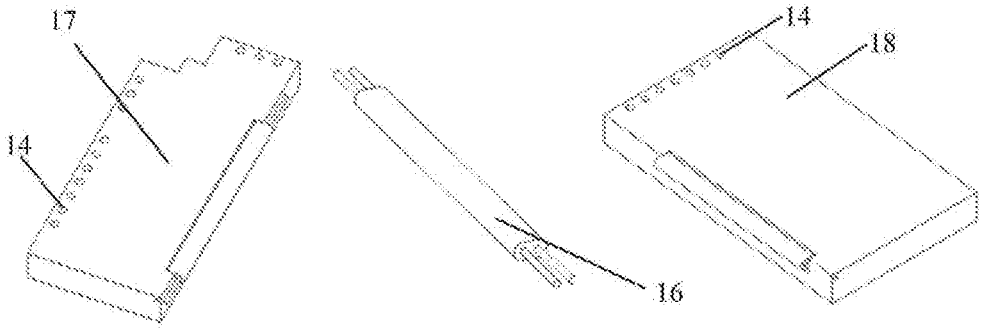
FIG. 11 is an exploded view of a folding wood slab.
Figure 12:
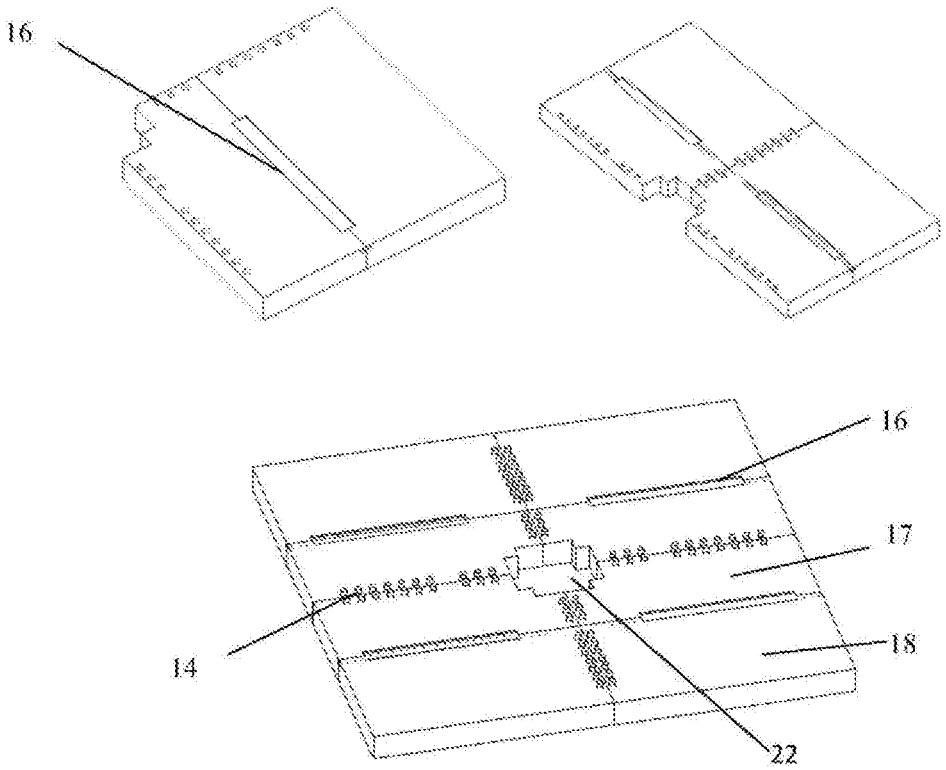
FIG. 12 is an assembled diagram of two adjacent folding wood slabs.
Figure 14:
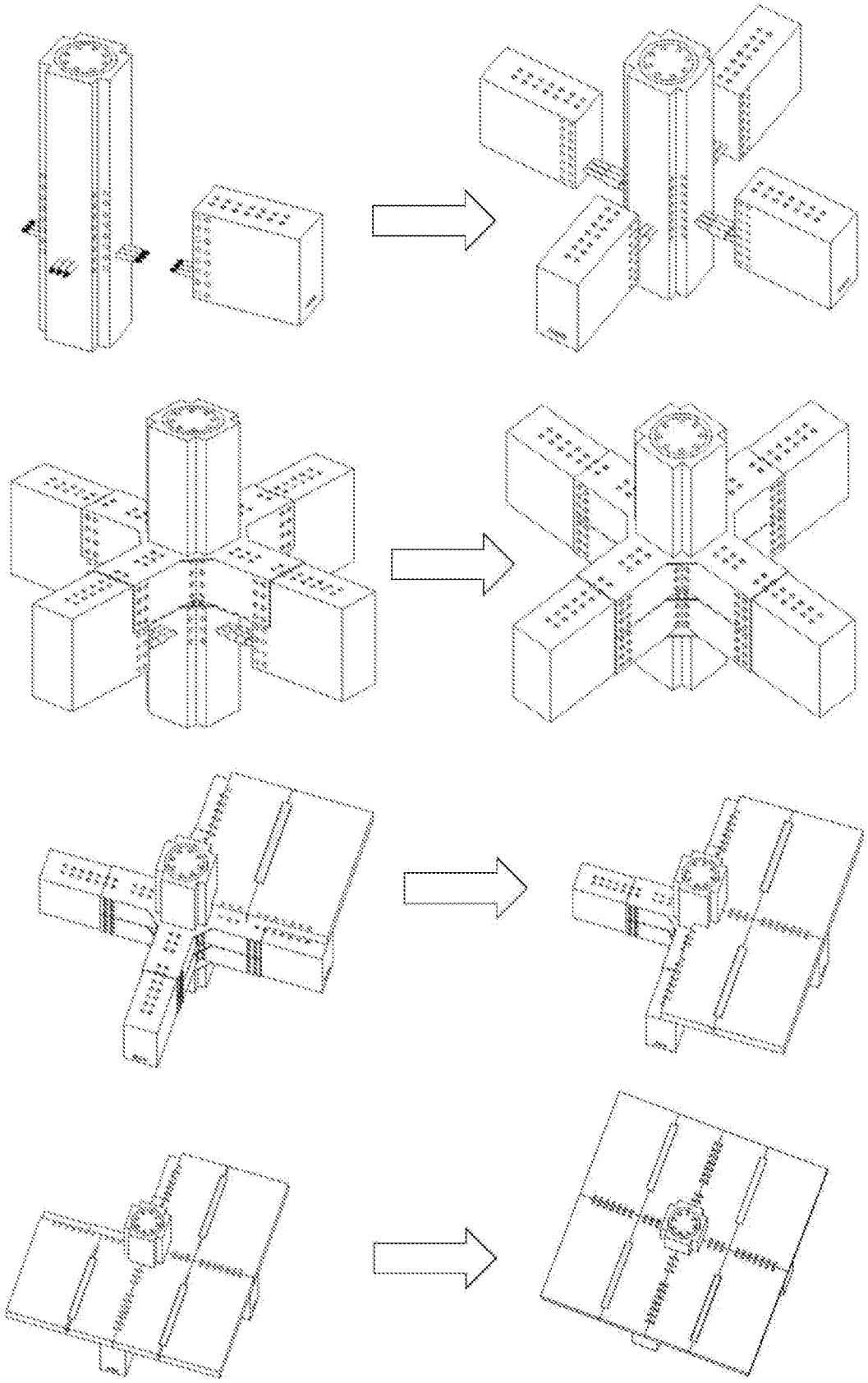
FIG. 14 is a schematic diagram of the whole assembly process of the folding slab and central column composite joint of the present application.

As shown in FIG. 1 to FIG. 12, a folding slab and central column composite joint mainly comprises a steel-wood composite column 1, square wood beams 2, folding wood slabs 3 and connecting assemblies 4. Wherein, The steel-wood composite column 1 comprises a hollow cross-shaped outer wood column 5, wherein a cylindrical steel sleeve 8 is inlaid in the cross-shaped outer wood column 5, a cylindrical inner wood column 19 is inlaid in the steel sleeve 8, column vertical steel bars 6 penetrate through the inner wood column 19; inner ends of horizontal steel bars 7 penetrate through the cross-shaped outer wood column 5 to be welded and fixed to the steel sleeve 8, tapered threads are arranged at outer ends of the horizontal steel bars 7, and first bolt holes 12 to be connected to the connecting assemblies 4 are formed in two sides of a cross-shaped surface of the cross-shaped outer wood column 5;

The square wood beams 2 have vertical protruding steel bars 10 stretching therein, and tapered threads are arranged at outer ends of the vertical protruding steel bars 10; second bolt holes 13 to be connected to the connecting assemblies 4 are formed in two sides of the ends of the square wood beams 2, and third bolt holes 14 to be connected to the folding wood slabs 3 are formed in the tops of the square wood beams 2;

A spindle 16 is connected between every two adjacent folding wood slabs 3, and third bolt holes 14 to be connected to the square wood beams 2 and the connecting assemblies 4 are formed in edge joints of the folding wood slabs; and particularly, near-column slabs 17 and square slabs 18 are connected through the spindles 16, W-shaped slots matched with the cross-shaped outer wood column 5 are formed in near-column ends of the near-column slabs 17, and a cross-shaped slot 22 is formed by the W-shaped slots of the four adjacent near-column slabs 17; and Each connecting assembly 4 comprises a tapered threaded sleeve 9 having two ends respectively connected to the horizontal steel bars 7 and the vertical protruding steel bars 10, and a double ring plate 11, wherein the double ring plate 11 comprises a cross-shaped upper ring plate 123 and a cross-shaped lower ring plate 456, which are of the same structure, are correspondingly connected in an overlapped manner, and are inserted into each other by means of dovetail concave grooves 23 and dovetail convex grooves 24; corner plates 15 are arranged on connected cross-shaped roots of the upper ring plate 123 and the lower ring plate 456, and the upper ring plate 123 and the lower ring plate 456 have cross-shaped slots 21 which are identical in shape with the cross-shaped outer wood columns 5; the corner plates 15 have fourth bolt holes 20 used for fixed connection after the upper and lower ring plates are overlapped; first bolt holes 12 to be connected to the cross-shaped outer wood column 5 are formed in inner ends, close to the cross-shaped roots; of the upper ring plate 123 and the lower ring plate 456; second bolt holes 13 to be connected to the square wood beams 2 are formed in inner ends of the upper ring plate 123 and the lower ring plate 456; and third bolt holes 14 to be connected to the square wood beams 2 and the folding wood slabs 3 are formed in top ends of the upper ring plate 123 and the lower ring plate 456.

As shown in FIG. 13, on the basis of the structural design of the folding slab and central column composite joint, an assembly method of the composite joint is implemented through the following steps:

Step 1): the steel sleeve 8 is disposed in the cross-shaped outer wood column 5, the horizontal steel bars 7 are welded and fixed, the inner wood column 19 is filled in the cross-shaped outer wood column 5, and the column vertical steel bars 6 are inserted into the inner wood column 19;

Step 2): the vertical protruding steel bars 10 are inserted into the square wood beams 2 and protrude out of the square wood beams 2;

Step 3): after the steel-wood composite column 1 and the square wood beams 2 are assembled, protruding parts of the steel bars are connected through the threaded sleeves 9;

Step 4): the upper ring plates 123 and the lower ring plates 456 are inserted into each other by means of the dovetail concave grooves 23 and the dovetail convex grooves 24, and the corner plates 15 of the upper ring plates 123 and the lower ring plates 456 are assembled and fixed together to form the double ring plates 11;

Step 5): the cross-shaped outer wood column 5 penetrates through the double ring plates 11 via the cross-shaped slots 21, and the double ring plates 11 are fastened and connected with the cross-shaped outer wood column 5 and the square wood beams 2 through bolts; and Step 6): the near-column slabs 17 of the four adjacent folding wood slabs 3 are disposed around the cross-shaped outer wood column 5, and the near-column slabs 17 and the square slabs 18 are overlapped, fastened and connected with the double ring plates 11 and the square wood beams 2 through bolts.

According to the present application, the wood structure is easy to process, low in weight and high in strength and has good seismic performance, the steel structure is uniform in texture and good in strength, plasticity and tenacity, and bean-column components in the structure can be connected through bolts, so that the components of the joint can be replaced, and the overall life of the structure is prolonged; compared with I-beams, the square wood beams adopted by the composite joint have better shear resistance; the steel bars are arranged in the square wood beams, so that the stress performance of the column is improved; completely prefabricated construction is realized, the construction progress is accelerated, the construction period is shortened, and the construction cost is reduced; and according to the central column steel-wood composite joint, steel is added to the wood structure to improve the tension resistance, compression resistance and bending resistance of the wood structure, so that the wood structure has good seismic performance under the effect of an earthquake.

Similar technical solutions can be derived in combination with the accompanying drawings and the solution described above. All solutions obtained without departing from the structure of the present invention should also fall within the protection scope of the present application.

What is claimed is:

1. A folding slab and a central column composite joint, comprising a steel-wood composite column, a plurality of square wood beams, a plurality of connecting assemblies for connecting the steel-wood composite column and the plurality of square wood beams, and a plurality of folding wood slabs connected with and supported by the steel-wood composite column, the plurality of square wood beams and the plurality of connecting assemblies, wherein:

the steel-wood composite column comprises a hollow cross-shaped outer wood column, wherein a steel sleeve is inlaid in the cross-shaped outer wood column, an inner wood column is inlaid in the steel sleeve, a plurality of column vertical steel bars penetrate through the inner wood column, a plurality of inner ends of a plurality of horizontal steel bars penetrate through the cross-shaped outer wood column to be fixedly connected to the steel sleeve, a plurality of tapered threads are arranged at a plurality of outer ends of the plurality of horizontal steel bars, and a plurality of first bolt holes to be connected to the plurality of connecting assemblies are formed in two sides of a cross-shaped surface of the cross-shaped outer wood column;

a spindle of a plurality of spindles is connected between every two adjacent folding wood slabs of the plurality of folding wood slabs, and a plurality of third bolt holes to be connected to the plurality of square wood beams and the plurality of connecting assemblies are formed in a plurality of edge joints of the plurality of folding wood slabs;

the plurality of square wood beams have a plurality of vertical protruding steel bars stretching in the plurality of square wood beams, and a plurality of threads are arranged at a plurality of outer ends of the plurality of vertical protruding steel bars;

each connecting assembly of the plurality of connecting assemblies comprises a threaded sleeve of a plurality of threaded sleeves having two ends of the threaded sleeve of the plurality of threaded sleeves respectively connected to the plurality of horizontal steel bars and the plurality of vertical protruding steel bars, and a double ring plate of a plurality of double ring plates;

a plurality of second bolt holes to be connected to the plurality of double ring plates are formed in two sides of ends of the plurality of square wood beams, and the plurality of third bolt holes to be fixedly connected to the plurality of folding wood slabs are formed in a plurality of tops of the plurality of square wood beams; and the double ring plate of the plurality of double ring plates comprises a cross-shaped upper ring plate of a plurality of cross-shaped upper ring plates and a cross-shaped lower ring plate of a plurality of cross-shaped lower ring plates, wherein a plurality of corner plates are arranged on a plurality of connected cross-shaped roots of the cross-shaped upper ring plate of the plurality of cross-shaped upper ring plates and the cross-shaped lower ring plate of the plurality of cross-shaped lower ring plates, and a plurality of fourth bolt holes used for fixed connection after the cross-shaped upper ring plate of the plurality of cross-shaped upper ring plates and the cross-shaped lower ring plate of the plurality of cross-shaped lower ring plates are overlapped are formed in the plurality of corner plates; the plurality of first bolt holes to be connected to the cross-shaped outer wood column are formed in inner ends of the cross-shaped upper ring plate of the plurality of cross-shaped upper ring plates and the cross-shaped lower ring plate of the plurality of cross-shaped lower ring plates; the plurality of second bolt holes to be connected to the plurality of square wood beams are formed in outer sides of ends of the cross-shaped upper ring plate of the plurality of cross-shaped upper ring plates and the cross-shaped lower ring plate of the plurality of cross-shaped lower ring plates; and the plurality of third bolt holes to be connected to the plurality of square wood beams and the plurality of folding wood slabs are formed in a plurality of top ends of the cross-shaped upper ring plate of the plurality of cross-shaped upper ring plates and the cross-shaped lower ring plate of the plurality of cross-shaped lower ring plates.

2. The folding slab and the central column composite joint according to claim 1, wherein the cross-shaped upper ring plate of the plurality of cross-shaped upper ring plates and the cross-shaped lower ring plate of the plurality of cross-shaped lower ring plates of the double ring plate of the plurality of double ring plates have a plurality of cross-shaped slots identical in shape with the cross-shaped outer wood column.

3. The folding slab and the central column composite joint according to claim 2, wherein a plurality of dovetail concave grooves and a plurality of dovetail convex grooves used for an insertion are symmetrically formed in a plurality of connected edges of the cross-shaped upper ring plate of the plurality of cross-shaped upper ring plates and the cross-shaped lower ring plate of the plurality of cross-shaped lower ring plates.

4. The folding slab and the central column composite joint according to claim 3, wherein a plurality of near-column slabs and a plurality of square slabs of the plurality of folding wood slabs are connected through the plurality of spindles, a plurality of W-shaped slots matched with the cross-shaped outer wood column are formed in a plurality of near-column ends of the plurality of near-column slabs, and a cross-shaped slot is formed by the plurality of W-shaped slots of four adjacent near-column slabs.

5. An assembly method of the folding slab and a central column composite joint according to claim 1, comprising the following steps:

step 1): disposing the steel sleeve in the cross-shaped outer wood column, welding and fixing the plurality of horizontal steel bars, filling the inner wood column in the cross-shaped outer wood column, and inserting the plurality of column vertical steel bars in the inner wood column;

step 2): inserting the plurality of vertical protruding steel bars in the plurality of square wood beams, and enabling the plurality of vertical protruding steel bars to protrude out of the plurality of square wood beams;

step 3): after the steel-wood composite column and the plurality of square wood beams are assembled, connecting a plurality of protruding parts of the plurality of vertical protruding steel bars through the plurality of threaded sleeves;

step 4): inserting the plurality of cross-shaped upper ring plates and the plurality of cross-shaped lower ring plates into each other by means of a plurality of dovetail concave grooves and a plurality of dovetail convex grooves at a plurality of joints, and assembling and fixing the plurality of corner plates of the plurality of cross-shaped upper ring plates and the plurality of cross-shaped lower ring plates together to form the plurality of double ring plates;

step 5): inserting the cross-shaped outer wood column into the plurality of double ring plates via the plurality of cross-shaped slots, and fastening and connecting the plurality of double ring plates with the cross-shaped outer wood column and the plurality of square wood beams through a plurality of bolts; and step 6): disposing four adjacent folding wood slabs around the cross-shaped outer wood column, and overlapping, fastening and connecting the plurality of near-column slabs and the plurality of square slabs with the plurality of double ring plates and the plurality of square wood beams through the plurality of bolts.

6. The assembly method of the folding slab and a central column composite joint according to claim 2, comprising the following steps:

step 1): disposing the steel sleeve in the cross-shaped outer wood column, welding and fixing the plurality of horizontal steel bars, filling the inner wood column in the cross-shaped outer wood column, and inserting the plurality of column vertical steel bars in the inner wood column;

step 2): inserting the plurality of vertical protruding steel bars in the plurality of square wood beams, and enabling the plurality of vertical protruding steel bars to protrude out of the plurality of square wood beams;

step 3): after the steel-wood composite column and the plurality of square wood beams are assembled, connecting a plurality of protruding parts of the plurality of vertical protruding steel bars through the plurality of threaded sleeves;

step 4): inserting the plurality of cross-shaped upper ring plates and the plurality of cross-shaped lower ring plates into each other by means of a plurality of dovetail concave grooves and the plurality of dovetail convex grooves at a plurality of joints, and assembling and fixing the plurality of corner plates of the plurality of cross-shaped upper ring plates and the plurality of cross-shaped lower ring plates together to form the plurality of double ring plates;

step 5): inserting the cross-shaped outer wood column into the plurality of double ring plates via the plurality of cross-shaped slots, and fastening and connecting the plurality of double ring plates with the cross-shaped outer wood column and the plurality of square wood beams through a plurality of bolts; and step 6): disposing four adjacent folding wood slabs around the cross-shaped outer wood column, and overlapping, fastening and connecting the plurality of near-column slabs and the plurality of square slabs with the plurality of double ring plates and the plurality of square wood beams through the plurality of bolts.

7. The assembly method of the folding slab and a central column composite joint according to claim 3, comprising the following steps:

step 1): disposing the steel sleeve in the cross-shaped outer wood column, welding and fixing the plurality of horizontal steel bars, filling the inner wood column in the cross-shaped outer wood column, and inserting the plurality of column vertical steel bars in the inner wood column;

step 2): inserting the plurality of vertical protruding steel bars in the plurality of square wood beams, and enabling the plurality of vertical protruding steel bars to protrude out of the plurality of square wood beams;

step 3): after the steel-wood composite column and the plurality of square wood beams are assembled, connecting a plurality of protruding parts of the plurality of vertical protruding steel bars through the plurality of threaded sleeves;

step 4): inserting the plurality of cross-shaped upper ring plates and the plurality of cross-shaped lower ring plates into each other by means of the plurality of dovetail concave grooves and the plurality of dovetail convex grooves at a plurality of joints, and assembling and fixing the plurality of corner plates of the plurality of cross-shaped upper ring plates and the plurality of cross-shaped lower ring plates together to form the plurality of double ring plates;

step 5): inserting the cross-shaped outer wood column into the plurality of double ring plates via the plurality of cross-shaped slots, and fastening and connecting the plurality of double ring plates with the cross-shaped outer wood column and the plurality of square wood beams through a plurality of bolts; and step 6): disposing four adjacent folding wood slabs around the cross-shaped outer wood column, and overlapping, fastening and connecting the plurality of near-column slabs and the plurality of square slabs with the plurality of double ring plates and the plurality of square wood beams through the plurality of bolts.

8. The assembly method of the folding slab and a central column composite joint according to claim 4, comprising the following steps:

step 1): disposing the steel sleeve in the cross-shaped outer wood column, welding and fixing the plurality of horizontal steel bars, filling the inner wood column in the cross-shaped outer wood column, and inserting the plurality of column vertical steel bars in the inner wood column;

step 2): inserting the plurality of vertical protruding steel bars in the plurality of square wood beams, and enabling the plurality of vertical protruding steel bars to protrude out of the plurality of square wood beams;

step 3): after the steel-wood composite column and the plurality of square wood beams are assembled, connecting a plurality of protruding parts of the plurality of vertical protruding steel bars through the plurality of threaded sleeves;

step 4): inserting the plurality of cross-shaped upper ring plates and the plurality of cross-shaped lower ring plates into each other by means of the plurality of dovetail concave grooves and the plurality of dovetail convex grooves at a plurality of joints, and assembling and fixing the plurality of corner plates of the plurality of cross-shaped upper ring plates and the plurality of cross-shaped lower ring plates together to form the plurality of double ring plates;

step 5): inserting the cross-shaped outer wood column into the plurality of double ring plates via the plurality of cross-shaped slots, and fastening and connecting the plurality of double ring plates with the cross-shaped outer wood column and the plurality of square wood beams through a plurality of bolts; and step 6): disposing four adjacent folding wood slabs around the cross-shaped outer wood column, and overlapping, fastening and connecting the plurality of near-column slabs and the plurality of square slabs with the plurality of double ring plates and the plurality of square wood beams through the plurality of bolts.

* * * * *